US008550156B2

(12) United States Patent
Castillo et al.

(10) Patent No.: US 8,550,156 B2
(45) Date of Patent: Oct. 8, 2013

(54) SWELLING PACKER

(75) Inventors: Robert O. Castillo, Stafford, TX (US); Anthony P. Foster, Katy, TX (US)

(73) Assignee: Baker hughes Incorporated, Houston, TX (US)

( * ) Notice: Subject to any disclaimer, the term of this patent is extended or adjusted under 35 U.S.C. 154(b) by 0 days.

(21) Appl. No.: 13/313,497

(22) Filed: Dec. 7, 2011

(65) Prior Publication Data

US 2012/0312526 A1 Dec. 13, 2012

Related U.S. Application Data

(62) Division of application No. 12/469,576, filed on May 20, 2009, now Pat. No. 8,127,978.

(51) Int. Cl.
*E21B 33/12* (2006.01)

(52) U.S. Cl.
USPC ..... 166/180; 166/179

(58) Field of Classification Search
USPC ..... 166/179, 180, 196; 277/323, 343
See application file for complete search history.

(56) References Cited

U.S. PATENT DOCUMENTS

| | | | | |
|---|---|---|---|---|
| 2,390,112 | A | 12/1945 | McGaffey | |
| 6,779,550 | B1 | 8/2004 | Bennett et al. | |
| 7,478,679 | B2 | 1/2009 | Berzin et al. | |
| 7,832,490 | B2 * | 11/2010 | Willauer | 166/387 |
| 2001/0037881 | A1 | 11/2001 | Brecheisen | |
| 2007/0151724 | A1 * | 7/2007 | Ohmer et al. | 166/187 |
| 2008/0078561 | A1 | 4/2008 | Chalker et al. | |
| 2008/0185158 | A1 | 8/2008 | Chalker et al. | |
| 2008/0210418 | A1 | 9/2008 | Knippa et al. | |

OTHER PUBLICATIONS

TI Automotive Brochure on HVAC Fluid Carrying Systems, Innovation Solutions Integration, date unknown, 2 pages.
http://www.bil-ibs.be/eng/Research/research_2008_MPW.htm, BIO—Magnetic Pulse Welding, Innovative electromagnetic high-velocity welding techniques (magnetic pulse welding), 5 pages.
http://www.pulsar.co.il/technology/?did=16, Pulsar: Magnetic Welding Solutions, MP-Weld—magnetic Pulse Welding, 3 pages.
http://www.pulsar.co.il/echnology/?did=16, Pulsar: Magnetic Crimping Solutions, MP-Crimp—magnetic Pulse Crimping, 2 pages.
Yakeley, S., et al., "Swellable Packers for Well Fracturing and Stimulation", SPE 110621, Nov. 2007, 1-7.

(Continued)

*Primary Examiner* — Giovanna Wright
*Assistant Examiner* — Robert E Fuller
(74) *Attorney, Agent, or Firm* — Steve Rosenblatt

(57) ABSTRACT

A swelling element packer is made with internal rings that are either split or scrolled. After the swelling element is built on a temporary mandrel a longitudinal seam of a variety of designs is cut through the element. This allows the rapid deployment of the element on the tubular that will be a part of a string and will serve as the final mandrel. The assembly is then magnetic pulse welded or crimped so as to urge the open ends of the rings to move toward each other and become secured to each other and further opening the possibility of attaching parts on the ring itself to the underlying tubular by displacing or otherwise removing the swelling material that was between the ring and the final mandrel when the magnetic pulse process began. The rings can be embedded wholly within the element or can extend beyond the opposed ends.

12 Claims, 6 Drawing Sheets

(56) References Cited

OTHER PUBLICATIONS

Infra, Morry, et al., "New Inflow Control Device Provides Solid-Liner Functionality Throughout Installation and Fluid Loss Control During Completion", SPE 134576, Sep. 2010, 1-12.

Coronado, Martin P., et al., "Latest-Generation Inflow Control Device Technology Provides Added Functionality During Completion with Improved Well Control Features", IPTC 13862, Dec. 2009, 1-12.

* cited by examiner

SWELLING PACKER

PRIORITY INFORMATION

This application is a divisional of U.S. patent application Ser. No. 12/469,576 filed on May 20, 2009.

FIELD OF THE INVENTION

The field of this invention is isolation devices for subterranean use and more particularly packers that swell and related methods of manufacturing them.

BACKGROUND OF THE INVENTION

Various manufacturing techniques have been devised to make swelling packers of the type that extend for a substantial length of a tubular. One such method is discussed in detail in U.S. Pat. No. 7,478,679 and shown in FIG. 5. It uses a sleeve 10 that is slipped over a tubular mandrel 12 that is typically a stand of a tubular string. The tubular string except for the mandrel is not shown. A mold is placed over the tubular leaving space at opposed ends to inject epoxy that can then set up and become end rings 14 and 16. Metal end rings can instead be spot welded.

This is meant as a design that can be field assembled. It uses a seamless sleeve that has to be fed over the end of the pipe and presents certain logistical issues in handling of the pipe and the sleeve to get the sleeve 10 on the pipe 12 quickly and without damage followed by having to pick up the stand of pipe and make it up to the string in a manner that will not damage the element 10.

Another technique of assembly of swelling packers is illustrated in US Publication 2008/0210418 that is discussed below in conjunction with FIGS. 1-4. FIG. 2 shows a mandrel 20 used for the construction technique while FIG. 3 shows one of two similar jacket halves 22 that are generally metal sheet rolled at 24 to a diameter somewhat larger than the intended outside diameter of the mandrel 20. A series of aligned elongated slots 26 are put there to allow the rubber to better retain the halves 22 when the two of them are mounted over the mandrel 20 after an initial layer of the swelling material 28 is built up on the mandrel 20. Each of the halves 22 has a series of spaced rounded end loops 30 through which a rod 32 is inserted before the now connected halves 22 are applied to the first layer of swelling material 28. Located at the opposite end from loops 30 are loops 34 that are somewhat rectangular shaped and that will ultimately accept a pin 36 that has the same general shape as the loops 34 and gets narrower toward its lower end 38. A dummy pin is inserted into loops 34 during the rubber wrapping process and curing or vulcanization cycle to keep the rubber out of them. During the vulcanization cycle, the outer layer of swelling material 28 is fully bonded to the halves 22 and the inner swelling layer. The dummy pin is pulled out of loops 34 and a lengthwise undulating seam 40 is cut through the swelling material in the gap between the halves 22 that has opened up when the dummy pin (not shown) was pulled out. There now is an open seam in the swelling element 28 that allows it to be slipped over any similar size mandrel or tubular string like 20. Once the assembly is over the mandrel 20 the loops 34 are again lined up or pulled into alignment by insertion of the pin 36 into an end loop and driving the pin 36. Once a few loops are temporarily held in alignment to insert the pin 36, the wedge shape of the pin 36 brings the remaining loops 34 into alignment as the pin 36 advances. The intent is to have the pin 36 wedge in the loops 34 so that it stays put when the assembly is run into the well and the element 28 swells to seal the wellbore.

While the above described technique accomplishes the intended task it requires size specific inventory of the halves 22 and has a few inherent complexities in the many steps of the manufacturing process to get the halves secured to each other and temporarily secured around the layup layer of the swelling material while more swelling material is applied. Additionally, the act of removal of the temporary pin from loops 34 and making the longitudinal seam 40 without damage to the loops 34 can also be a challenge. Finally, getting the loops 34 initially aligned so that a very long pin 36 can be driven through the loops to close the seam 40 tightly can also present assembly challenges.

The present invention targets some of the difficulties in the designs discussed above and presents a method and a resulting product that is simpler to assemble and deploy in the field and allows for use of a parts inventory that has fewer discrete parts to handle a broad range of sizes. It encompasses using split rings that can be embedded totally or partially coupled with using magnetic pulse welding and/or crimping techniques to adhere the split ring ends to each other and/or the underlying mandrel. By closing a longitudinal seam in the swelling material in this manner, the seam is better sealed and the assembly goes together faster with greater assurance that it will remain intact as the assembly is run downhole and the sealing element swells. The split rings are economical to field fabricate to the approximate desired material reducing the need for unique inventory and again making field assembly simpler even with minimally trained personnel. In an alternative embodiment the ends can overlay the swelling element and be joined by magnetic pulse welding or crimping techniques such as those offered by Pulsar Ltd. of Raanana, Israel and whose magnetic pulse welding technique is described at http://www.pulsar.co.il/technology/?did=16.

U.S. Pat. No. 6,779,550 illustrates magnetic pulse welding techniques to make a pressurized canister.

Those skilled in the art will appreciate other aspects of the invention from a review of the preferred embodiment description and associated drawings while recognizing that the full scope of the invention is to be determined from the appended claims.

SUMMARY OF THE INVENTION

A swelling element packer is made with internal rings that are either split or scrolled. After the swelling element is built on a temporary mandrel a longitudinal seam of a variety of designs is cut through the element. This allows the rapid deployment of the element on the tubular that will be a part of a string and will serve as the final mandrel. The assembly is then magnetic pulse welded or crimped so as to urge the open ends of the rings to move toward each other and become secured to each other and further opening the possibility of attaching parts on the ring itself to the underlying tubular by displacing or otherwise removing the swelling material that was between the ring and the final mandrel when the magnetic pulse process began. The rings can be embedded wholly within the element or partially embedded where the exposed portion of the ring may be a face located along the outer or inner diameter of the rubber element or the ring can extend beyond the opposed ends or any combination.

DETAILED DESCRIPTION OF THE PREFERRED EMBODIMENT

Figure 1:
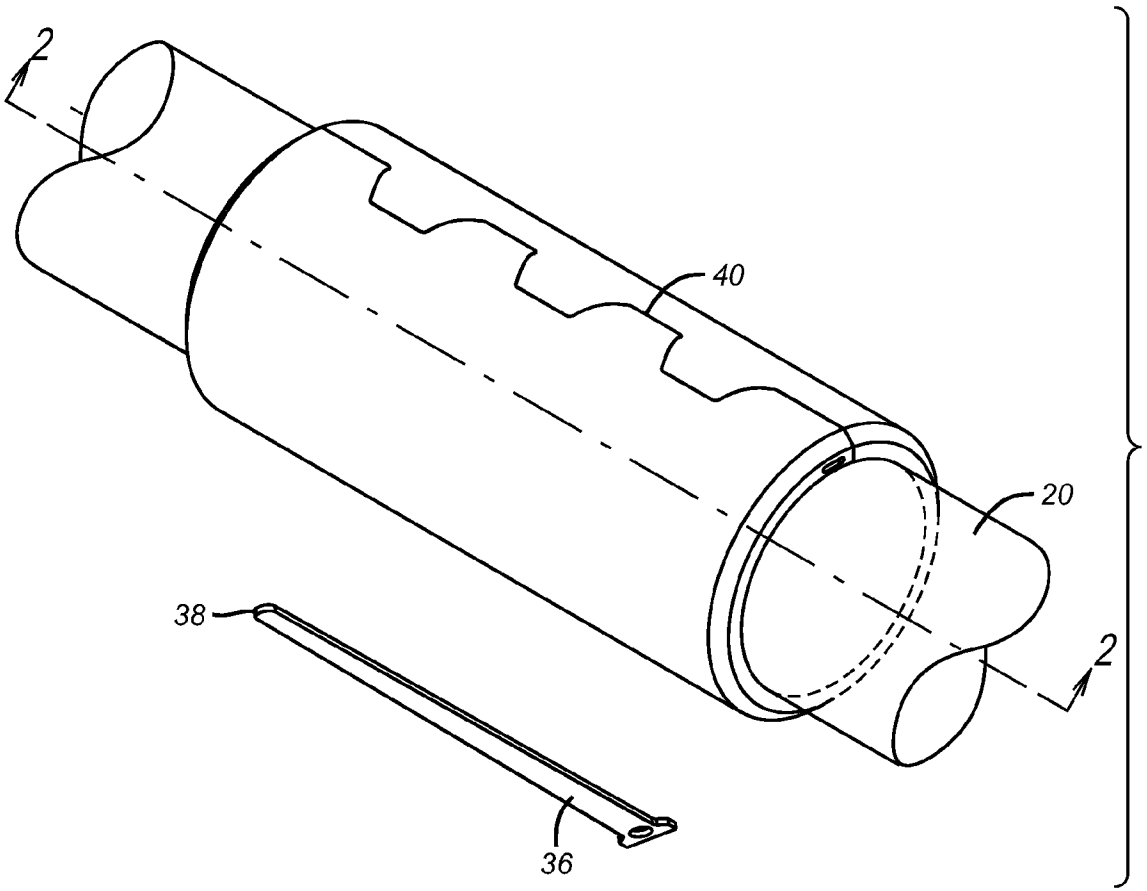
(PRIOR ART) FIG. 1
FIG. 1 is a prior art perspective view of a swelling packer with an internal support.
Figure 2:
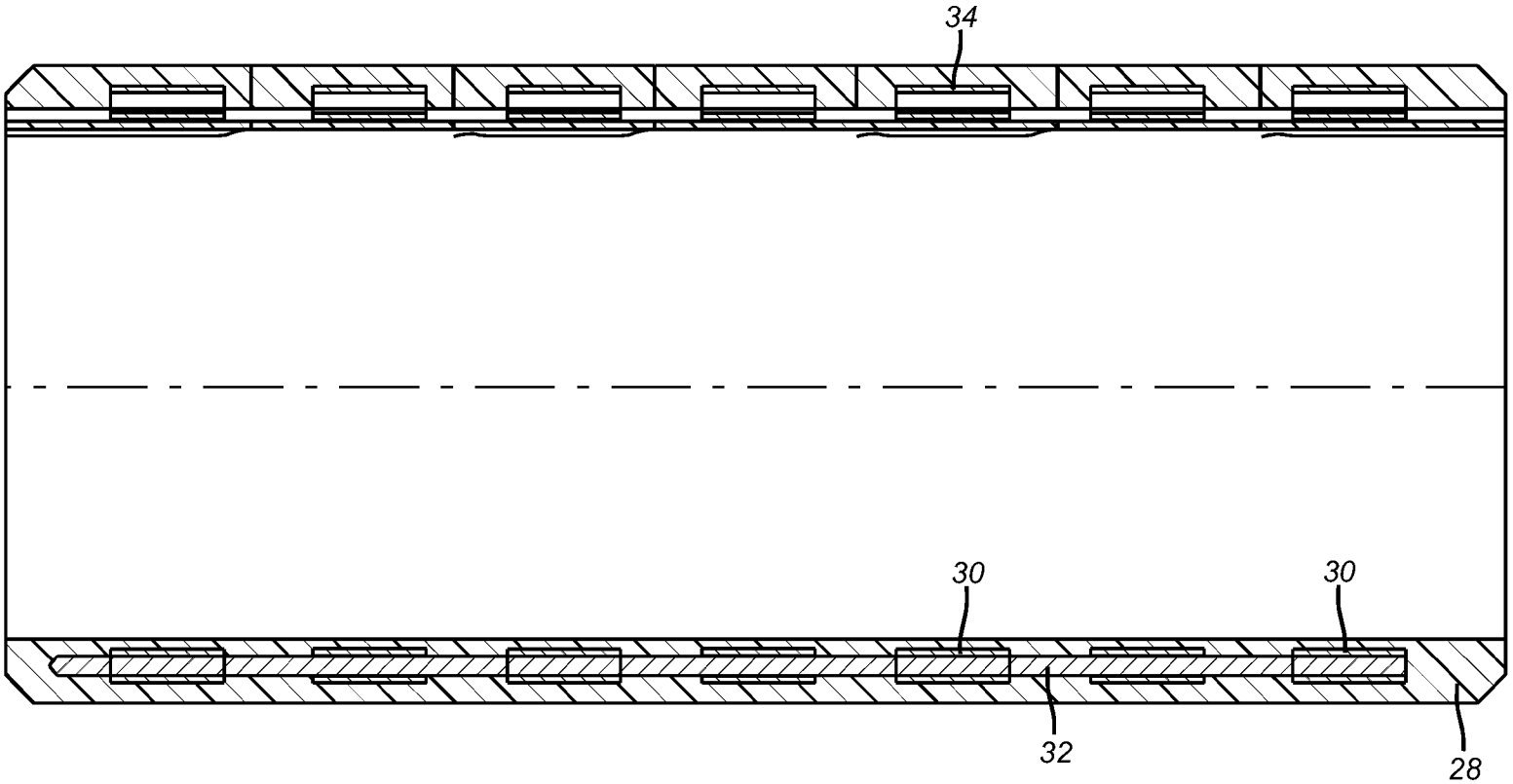
(PRIOR ART) FIG. 2
FIG. 2 is a section view through lines 2-2 of FIG. 1.
Figure 3:
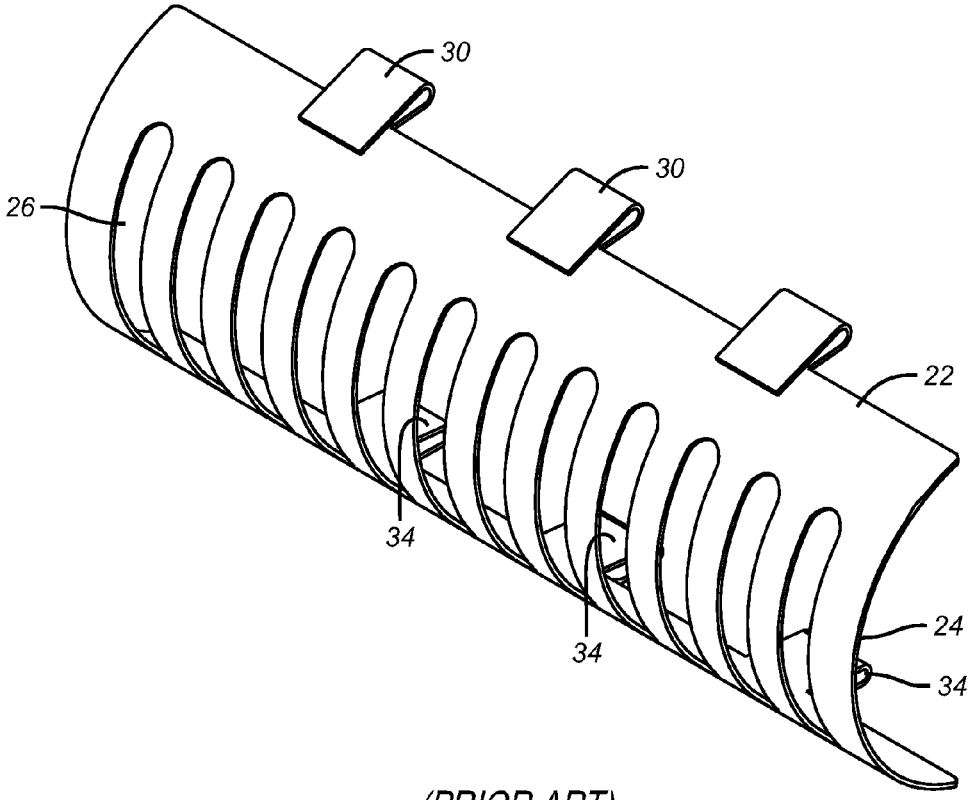
(PRIOR ART) FIG. 3
FIG. 3 is a perspective view of an internal support used in the packer of FIG. 1.
Figure 4:
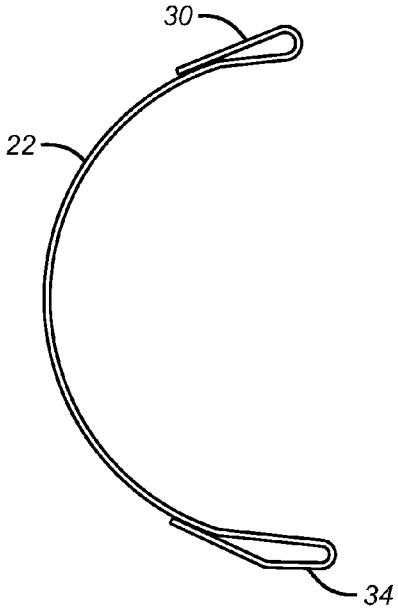
(PRIOR ART) FIG. 4
FIG. 4 is an end view of the support member shown in FIG. 3.
Figure 5:
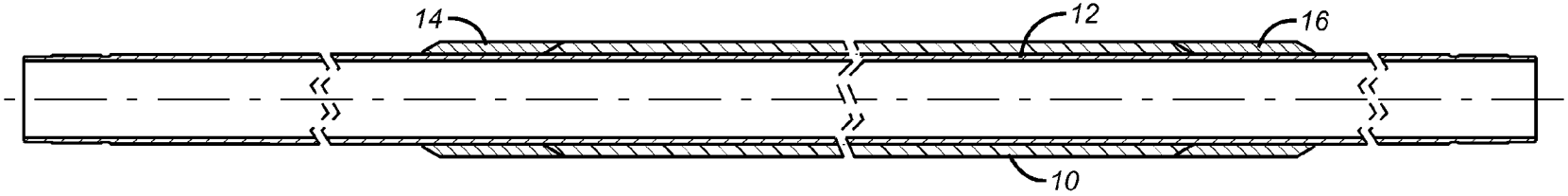
(PRIOR ART) FIG. 5
FIG. 5 another prior art design using a long tube of a swellable material with opposed retaining rings.
Figure 6:
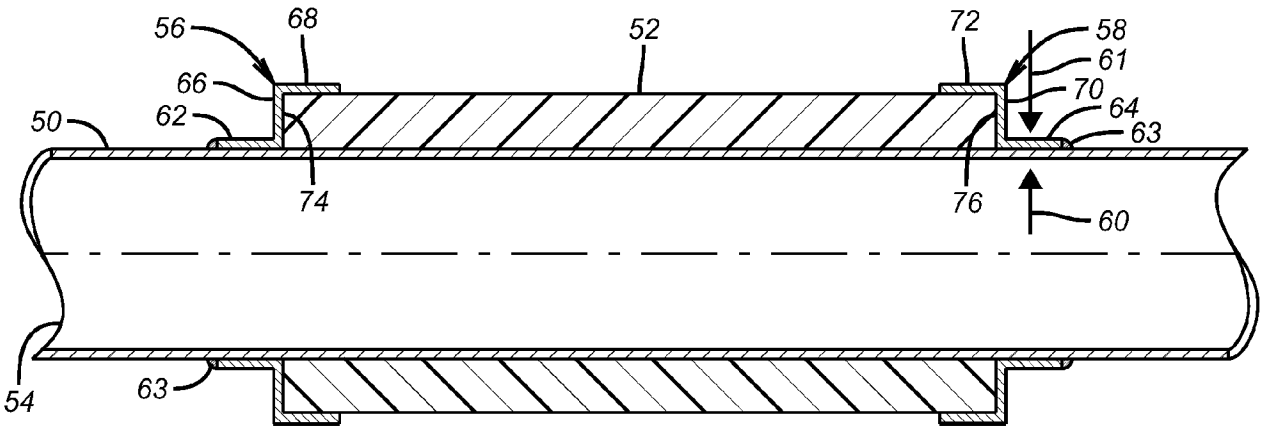
FIG. 6 is a section view of a swelling packer with end retaining rings secured to the mandrel by magnetic pulse welding or crimping.

Referring to FIG. 6 a mandrel 50 is preferably a threaded API tubular that can be assembled into a tubular string (not shown). A swelling sealing element 52 can be seamless and inserted over an end 54 of the mandrel 50 or it can optionally have a longitudinal seam (not shown). After the element 52 is in place on the mandrel 50 end rings 56 and 58 can be slipped over the mandrel 50 on opposed ends of the element 52. Arrows 60 and 61 schematically represent a known device that can perform magnetic pulse welding or crimping, also known as cold welding or cold crimping, as the assembly is moved through the magnetic field that it generates. Each preferably seamless ring is preferably in three planes preferably with two 90 degree bends with segments 62 and 64 becoming pulse welded 63 or mechanically fastened to the mandrel 50. Segments 66 and 68 and 70 and 72 surround the ends 74 and 76 of the element 52 and prevent it from moving with respect to the mandrel 50 or axially flowing or extruding in response to differential pressure after the swelling occurs. Optionally the mandrel 50 can also be expanded from within using a swage or other expansion techniques to further enhance the seal of the swelled element 52. The swelling material can be sensitive to well fluids such as hydrocarbons or water and can also optionally carry an outer covering to delay swelling to allow additional time for proper placement of the sealing element 52.

The use of magnetic pulse welding or crimping techniques eliminates heat affected zones used in traditional welding techniques and secures an attachment that is comparable. It is also far superior to using mechanical fasteners that can come loose or get sheared off or otherwise damaged when being run in.

Figure 8:
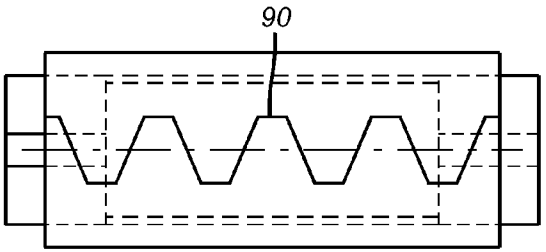
FIG. 8 is the design of FIG. 7 with a zigzag seam.
Figure 9:
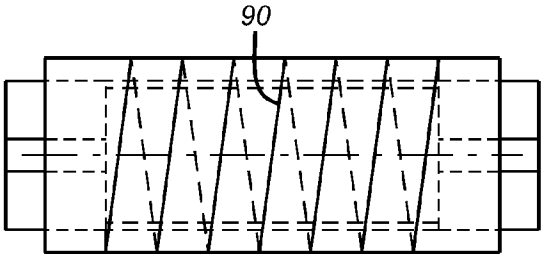
FIG. 9 is the view of FIG. 7 with a spiral seam.
Figure 10:
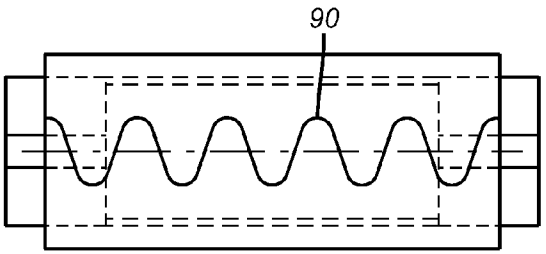
FIG. 10 is the view of FIG. 7 with sinusoidal seam.
Figure 7:
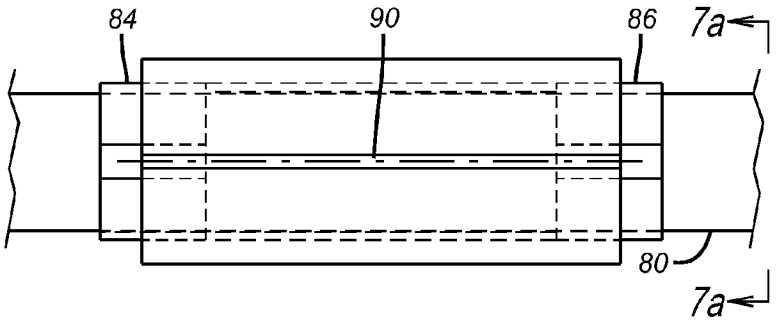
FIG. 7 shows a swelling element with a straight seam with support rings extending out opposite ends.
Figure 7B:
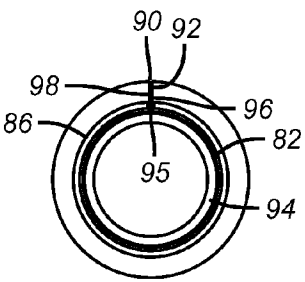
Figure 7A:
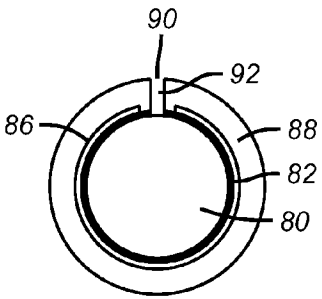
Figure 12:
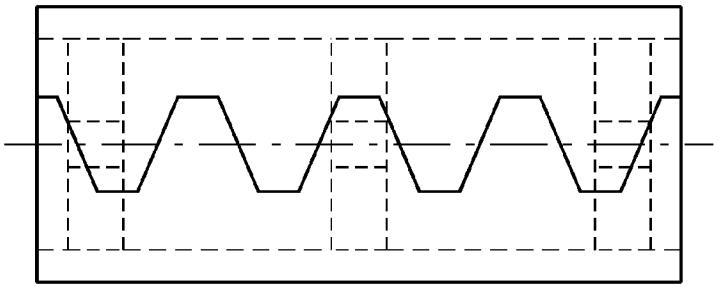
FIG. 12 is the view of FIG. 11 with a zigzag seam.
Figure 14:
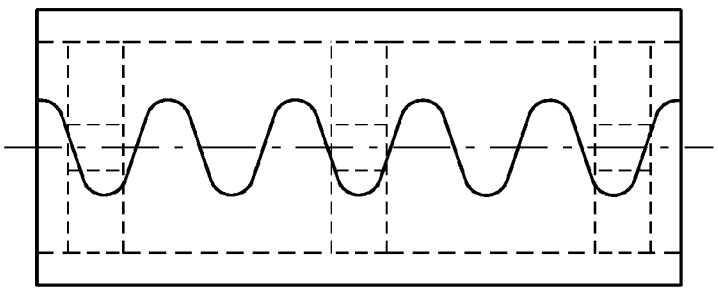
FIG. 14 is the view of FIG. 11 with a sinusoidal seam.
Figure 11:
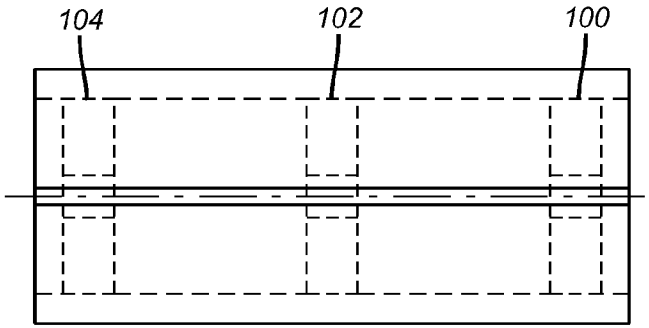
FIG. 11 shows a swelling element with a straight seam with embedded support rings.
Figure 13:
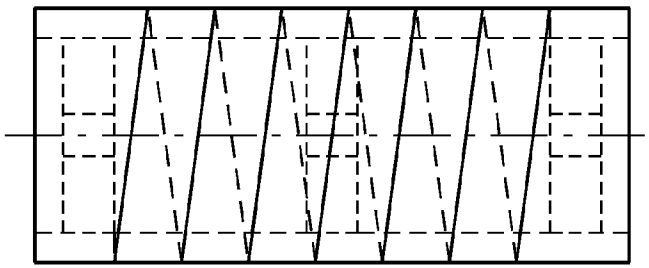
FIG. 13 is the view of FIG. 11 with a spiral seam.

FIGS. 7, 7*a* and 7*b* are shown in detail and are in several ways exemplary of the other illustrated designs and their associated methods. An initial mandrel 80 has a layer of swelling material 82 built up over it without being bonded to it. Rings 84 and 86 are overlayed on layer 82 so as to extend beyond its respective ends as shown in FIG. 7. These rings 84 and 86 are preferably made of thin metal that can be rolled into a tube shape with a portion missing so that it has a c-shape when viewed on end. Alternatively the ring shapes can be an overlapping scroll having a round shape when viewed on end. After being placed over the inner swelling layer 82 and extending beyond it as shown in FIG. 7, another layer of swelling material 88 is wrapped up to the layer 82 with the ring structures sandwiched in between as shown in FIG. 7*a*. The assembly is cured and as a result of vulcanization and proper adhesive system the swelling rubber is bonded to the rings and creates a continuous rubber element. Notice that in the FIG. 7*a* embodiment there is a gap 90 between the ends of the ring 86, for example. The temporary mandrel 80 is removed and a seam 92 is cut lengthwise through the layers 82 and 88 with the only difference among FIGS. 7-10 being the orientation of the seam 90. While seam 90 is straight in FIG. 7 it is a zigzag in FIG. 8, a spiral in FIG. 9 and a sinusoid in FIG. 10. Other seam orientations are envisioned within the scope of the invention.

FIG. 7*b* shows what happens when the assembly in FIG. 7*a* is subjected to magnetic pulse welding fields. The ring 86 that had a c-ring shape with gapped ends through which seam 90 was cut move toward each other and toward the tubular 94 that has taken the place of the temporary mandrel 80 used in FIG. 7*a*. There are several outcomes that can happen as a result of the magnetic pulse welding procedure and how its settings are adjusted. The ends 96 and 98 are brought together and secured to each other. In another alternative, the ends 96 and 98 are brought together and brought toward the mandrel 94 and the ends attach not only to each other but also attach to the mandrel 94 at 95. In yet another alternative the ends 96 and 98 attach only to the mandrel 94. The effect of magnetic pulse welding is to attract and attach metals to each other whether similar or dissimilar and without heat to avoid the drawbacks of traditional welding processes and to allow joining materials not considered good traditional welding candidates such as aluminum. The process can also be referred to in this application as cold welding. Regardless of the shape of the cut seam 90, it is held closed as the procedure takes place. The procedure serves the purpose of holding together the seam 90. Those skilled in the art will appreciate that additional support rings can be imbedded between the rings 84 and 86 in between the layers 82 and 88 of the swelling material so that the seam 90 can be held closed over a greater portion of its length or for that matter its complete length. It should also be appreciated that the magnetic pulse welding procedure can result is some displacement of the layer 82 of swelling material that is disposed between the mandrel 94 and a ring such as 86. By making some of the rings extend past the ends of the swelling material layers 82 and 88 there is also visual feedback that the rings 84 or 86 have been brought together to have disparate or overlapping ends joined to each other.

FIGS. 11-14 show the same patterns as FIGS. 7-10 with the difference that instead of two rings 84 and 86 that stick out of the layers of swelling material there are discrete rings 100, 102 and 104 that are embedded or partially embedded (i.e. exposed to temporary mandrel 80) but are otherwise similarly constructed as rings 84 and 86 but are simply differently positioned. Any number of rings or one long c-shaped sleeve or scroll can be used with the purpose of providing rigidity to the swelling element. Even a loosely fitting initial cylindrical shape can be used and slipped over the initial layer of swelling material 82. This cylinder can be cut when the seam 90 is created. Then with the seam 90 held closed and the magnetic pulse welding procedure activated, the slit cylinder can have its ends rejoined to each other or to the underlying mandrel or both.

What results from the use of the rings or sleeves or cylinders that are embedded in the swelling element and then using magnetic pulse welding is that a firm support for the swelling element is provided without the issues described with using the techniques of FIGS. 1-4. There is no issue of heat that can ruin the swelling material or damage the mandrel. The process is dramatically streamlined and made more effective than the previous efforts to provide internal structural supports. Issues of getting a very long and flexible pin into aligned loops are eliminated. What results is an elongated swelling structure with support to keep a seam closed after the seam has served its purpose and allowed for rapid assembly onto a mandrel. The internal support that is secured to itself or/and the mandrel is more easily put into that position with the use of magnetic pulse welding. The internal supports can be made as needed and an inventory of different sizes does not need to be kept as with the members 22 of FIG. 3. Not only is labor time and material saved but the entire process of field assembly is made simple and the resulting packers that are produced are more durable for use downhole for effective zone isolation in the wellbore.

The above description is illustrative of the preferred embodiment and many modifications may be made by those skilled in the art without departing from the invention whose scope is to be determined from the literal and equivalent scope of the claims below.

We claim:

1. A barrier for subterranean use, comprising:

a mandrel;

a split swellable sealing element on said mandrel having opposed ends and at least one support circumferentially extending about said mandrel and extending partly into and partly beyond said swellable sealing element in the vicinity of at least one of said opposed ends and formed to be initially spaced from said mandrel, said support having circumferentially spaced ends;

said spacing of said support from said mandrel is removed when said circumferentially spaced ends of said support move as said circumferentially spaced ends are welded to at least one of each other and said mandrel at a location between said opposed ends of said swellable sealing element.

2. The barrier of claim 1, wherein:

said circumferentially spaced ends are cold welded.

3. The barrier of claim 1, wherein:

said circumferentially spaced ends of said support comprise a seam aligned with said split in said element.

4. The barrier of claim 3, wherein:

said circumferentially spaced ends of said support move into joined contact with each other.

5. The barrier of claim 4, wherein:

said circumferentially spaced ends are joined by cold welding.

6. The barrier of claim 3, wherein:

said split is cut straight, zigzag, spirally or sinusoidally.

7. The barrier of claim 3, wherein:

said support comprises a plurality of spaced supports with at least some completely embedded in said element.

8. The barrier of claim 3, wherein:

said at least one support comprises a plurality of spaced supports extending beyond said element.

9. The barrier of claim 3, wherein:

said circumferentially spaced ends move into welded contact with said mandrel.

10. The barrier of claim 3, wherein:

said circumferentially spaced ends displace a portion of said element as a portion of said support moves when cold welded to itself or said mandrel.

11. A barrier for subterranean use, comprising:

a mandrel;

a swelling sealing element having opposed ends;

at least one end ring extending partly into and embedded within said swelling sealing element in the vicinity of said end and partly beyond said end and cold welded or cold crimped to said mandrel at least within one of said opposed ends of said swelling sealing element to further secure said swelling sealing element to said mandrel between said opposed ends.

12. The barrier of claim 11, wherein:

said end ring overlaps said element between said opposed ends.

* * * * *